United States Patent [19]

Veres

[11] 4,344,630

[45] Aug. 17, 1982

[54] SEALINGLY MOUNTING ARRANGEMENT FOR PROPELLER SHAFTS OF WATERCRAFT

[76] Inventor: Imre Veres, Nienredder 21b, D-2000 Hamburg 54, Fed. Rep. of Germany

[21] Appl. No.: 99,854

[22] Filed: Dec. 3, 1979

[51] Int. Cl.[3] ..... F16J 15/34; F16J 15/54

[52] U.S. Cl. ..... 277/4; 277/65; 277/71; 277/173; 277/DIG. 8; 308/36.1; 308/237 A; 308/DIG. 4; 308/DIG. 12; 440/112

[58] Field of Search ..... 277/12, 4, 83, 133, 277/134, 173, 176, 177, 198, DIG. 8, 58, 65, 174, 175; 308/15, 36.1, 36.2, 237 A, DIG. 4, DIG. 12; 440/112

[56] References Cited

U.S. PATENT DOCUMENTS

| | | | |
|---|---|---|---|
| 727,382 | 5/1903 | Knudson | 308/DIG. 12 |
| 1,153,624 | 9/1915 | Johnson | 277/4 X |
| 2,203,039 | 6/1940 | Aker | 308/DIG. 12 |
| 2,233,557 | 3/1941 | Shager | 308/36.2 X |
| 2,471,187 | 5/1949 | Atwater | 308/DIG. 4 |
| 2,562,624 | 7/1951 | Loofbourrow | 277/4 |
| 2,690,360 | 9/1954 | Young | 277/177 X |
| 2,746,779 | 5/1956 | Lobanoff | 277/4 X |
| 3,057,646 | 10/1962 | Brumagim | 277/71 |

FOREIGN PATENT DOCUMENTS

| | | | |
|---|---|---|---|
| 1132021 | 6/1962 | Fed. Rep. of Germany | 440/112 |
| 2839816 | 3/1980 | Fed. Rep. of Germany | 440/112 |
| 467036 | 6/1937 | United Kingdom | 308/DIG. 4 |
| 667784 | 3/1952 | United Kingdom | 277/DIG. 8 |
| 1050330 | 12/1966 | United Kingdom | 308/DIG. 12 |
| 594380 | 2/1978 | U.S.S.R. | 277/173 |

*Primary Examiner*—Robert S. Ward, Jr.

*Attorney, Agent, or Firm*—Kontler, Grimes & Battersby

[57] ABSTRACT

An arrangement for sealingly mounting a propeller shaft in a passage of the stern region of a watercraft hull includes a supporting sleeve, a separating sleeve closely surrounding the propeller shaft and received in the supporting sleeve coaxially therewith and with the propeller shaft, dynamic seals in the interface between the propeller shaft and the separating sleeve, sliding or rolling-type bearings in the space between the supporting sleeve and the separating sleeve, and a shaft-type seals at the respective ends of the space between the supporting sleeve and the separating sleeve. The separating sleeve separates the bearings from the dynamic seals so that a lubricant which lubricates the bearings cannot escape into the waters partially surrounding the arrangement passed the dynamic seals. The shaft-type seals prevent the lubricant from escaping into the water or into the interior of the watercraft hull.

26 Claims, 1 Drawing Figure

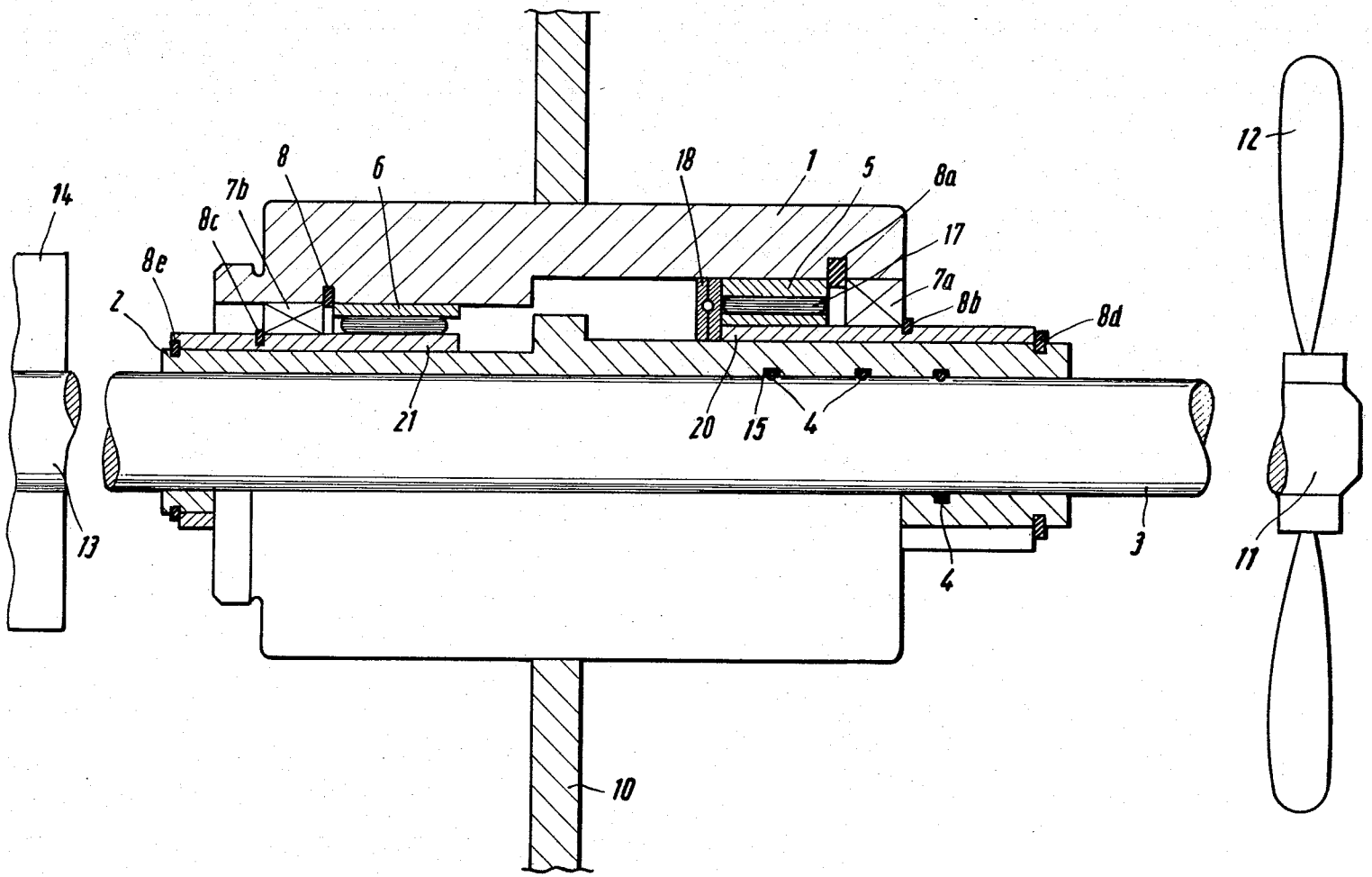
12
11
3
8d
8a
17
7a
8b
4
5
1
4
15
18
20
10
21
6
8
7b
8c
8e
2
14
13

SEALINGLY MOUNTING ARRANGEMENT FOR PROPELLER SHAFTS OF WATERCRAFT

BACKGROUND OF THE INVENTION

The present invention relates to an arrangement for sealingly mounting rotary members on supports in general, and more particularly to an arrangement for sealingly mounting a propeller shaft in a passage provided in a hull of a watercraft, such as a motorboat or yacht.

It can be observed that streams or bodies of water suffer of an ever-increasing pollution, especially when they are navigable and carry a substantial amount of boat traffic. A frequent source of this pollution is to be found in imperfect sealing of the driving elements which lets grease, oil or other lubricants escape into the water. One, and possibly the most offending, location at which this escape of lubricants may occur is the region of the support sleeve which passes through the stern zone of the hull of the watercraft and through which the propeller shaft extends from the interior to the exterior of the hull. Experience has shown that the worst offenders in this respect are small motorboats and yachts. This is primarily attributable to the fact that conventional bearings which are used in such watercraft are subjected to substantial loads and must be continuously lubricated. The bearing seals are subjected to a high degree of wear, so that the lubricants can escape and reach the water via the support sleeve which passes through the stern of the watercraft. On the other hand, water can also penetrate into the propeller shaft bearing which is accommodated in the interior of the support sleeve, so that corrosion phenomena can soon be observed at this region. A further disadvantage of the conventional propeller shaft mounting arrangements is to be seen in the fact that their assembly or mounting and disassembly or dismounting are not easy, especially since, in most instances, the propeller shaft has different diameters at different regions within the support sleeve. Even a small deviation from parallelism among the shaft, the support sleeve, and the prime mover, which can easily come in existence as a result of non-uniform transversely acting forces, often results in damage to the propeller shaft.

OBJECTS AND SUMMARY OF THE INVENTION

Accordingly, it is a general object of the present invention to avoid the disadvantages of the prior art.

More particularly, it is an object of the present invention to provide a sealingly mounting arrangement, especially for propeller shafts of watercraft, which is not possessed of the disadvantages of the conventional arrangements of this type.

Still another object of the invention is to so construct the arrangement here under consideration as to facilitate its assembly, disassembly and upkeep.

A concomitant object of the invention is to so design the arrangement as to be simple in construction, inexpensive to manufacture and assembly, and reliable nevertheless.

In accordance with these objects and others which will become apparent hereafter, one feature of the present invention resides in an arrangement for sealingly mounting a rotary member, particularly a propeller shaft, in a passage of a support, particularly of a watercraft hull, which comprises, briefly stated, dynamic sealing means; bearing means; and separating means interposed between the sealing means and the bearing means and fluid-tightly separating the former from the latter. Advantageously, the separating means includes a separating sleeve which surrounds the rotary member for relative movement, particularly for relative rotation, the sealing means being interposed between the separating sleeve and the rotary member. It is further currently preferred that the dynamic sealing means include one or more O-rings. It is also advantageous when the arrangement further includes a support sleeve which is mounted in the passage of the support, and when the separating sleeve is received in the support sleeve for rotation relative thereto.

When the arrangement is constructed in the above-indicated manner, that is, when it utilizes the expedient of separation of the dynamic sealing means from the bearing means, it is achieved that the propeller shaft does not load the sealing rings which are used for the sealing of the bearing means, and that the dynamic sealing means for the propeller shaft, which is constituted by the O-rings, does not come into contact with the lubricating agents which lubricate the bearing means. In this manner, any escape of the lubricants from the bearing means into the water is safely prevented.

In accordance with a currently preferred embodiment of the present invention, the supporting sleeve of the arrangement is not directly connected with the propeller shaft; rather, it accommodates the above-mentioned separating sleeve which is movable relative thereto and which slidingly receives the propeller shaft. In this manner, the propeller shaft is not directly supported on the bearing means, but the rotatable separating sleeve which rotatably guides the propeller shaft and protects the same from damage, is. The axial precision of the mounting arrangement for the propeller shaft is very high when the arrangement is constructed in the above-mentioned manner. Even extreme transverse loads do not result in any pronounced wear of the supporting sleeve or the propeller shaft. No water can penetrate into the hermetically closed mounting arrangement of the present invention even after an extended period of use. In this manner, occurrence of corrosion phenomena in the interior of the arrangement is safely avoided.

The supporting sleeve of the arrangement can be mounted on the support, such as the stern region of the watercraft hull, in a rigid or in a flexible manner. It can be connected by means of at least one flange, or it can be embedded in the support. The arrangement of the present invention is hermetically closed, as already mentioned before, so that the lubricants are used in a more economical manner than before. Furthermore, the lubricants are separated from, and thus prevented from reaching and exerting influence on, the dynamic O-ring sealing means. Thus, pollution of the water by escaping lubricants is safely prevented. Another advantage of the arrangement of the present invention is that its construction is very simple so that it requires almost no supervision or upkeep.

Advantageously, two bearing units are used as the bearing means, one of which includes an axial thrust ball bearing and a radial needle bearing, and the other one of which includes merely a radial needle bearing. The use of the needle bearings provides for a quiet and vibration-free operation even at high speeds of rotation. It is further advantageous when the supporting sleeve is provided with a thread by means of which the supporting sleeve can be connected to a flange, a bracket, or any other auxiliary arrangement for connecting the arrangement of the present invention to the hull of the ship and for holding it in a predetermined position.

The novel features which are considered as characteristic of the invention are set forth in particular in the appended claims. The improved arrangement for sealingly mounting a propeller shaft in a passage of a watercraft hull itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The sole FIGURE of the drawing is a partially sectioned side elevational view of the arrangement of the present invention.

DESCRIPTION OF THE PREFERRED EMBODIMENTS

Referring now to the drawing in detail, it may be seen that the arrangement of the present invention, which is mounted at the stern of a watercraft, includes, as its basic components, a support sleeve 1 and a separating sleeve 2. A propeller shaft extends coaxially through the sleeves 1 and 2. The supporting sleeve 1 is watertightly mounted in a stern region 10 of a watercraft hull. The propeller shaft 3 has mounted on its end which extends to the exterior of the stern region 10 a propeller 12 which serves for propelling the watercraft. The propeller shaft 3 is connected, at its end 13 which is located in the confines of the watercraft hull, in a conventional manner, with an output shaft 14 of a motor or a similar conventional prime mover.

The propeller shaft 3 is slidingly received in the separating sleeve 2. A plurality of O-rings 4 is arranged at the interface between the propeller shaft 3 and the separating sleeve 2. The O-rings 4 are received in respective grooves 15 and serve for dynamic sealing of the above-mentioned interface. The grooves 15, as illustrated, are machined into the separating sleeve 2 close to its end which faces the propeller 12. In order to achieve a high sealing affect with respect to water which penetrates into the above-mentioned interface from the propeller 12 in direction toward the output shaft 14, three of the O-rings 4 spaced in the axial direction of the propeller shaft 3 are provided, these O-rings for being accommodated in their respective grooves 15. It may be seen that there is provided one groove 15 for each of the O-rings 4, that is, that each of the grooves 15 accommodates only one of the O-rings 4. However, it will be appreciated that the situation could also be reversed, that is, the grooves 15 could be formed in the propeller shaft 3 and the O-rings 4 could be accommodated therein. At present, the first-mentioned solution is preferred for manufacturing and other engineering reasons.

The separating sleeve 2 is rotatably supported in the supporting sleeve 1 by means of two bearing units 5 and 6. The bearing unit 6 which is more remote from the propeller 12 than the bearing unit 5 is constructed as a needle bearing which is secured to the support sleeve 1 against shifting in the longitudinal or axial direction by means of a split ring 8.

The other bearing unit 5 includes a needle bearing 17 and ball bearing 18. The needle bearing 17 assumes the transverse forces which act substantially in the radial direction of the propeller shaft 3, while the ball bearing 18, which is preferably constructed as a combined axial thrust and radial bearing or as a pure axial thrust bearing, assumes the axial forces and/or the radial forces. The bearing unit 5 is positionally secured in the supporting sleeve 1 by means of a further split ring 8*a*.

In order to prevent the possibility that lubricants could penetrate from the interior of the supporting sleeve 1 to its exterior, there are provided at the propeller end as well as on the drive end of the supporting sleeve 1, sealing rings 7*a* and 7*b* which are connected to the separating sleeve 2 by means of associated split rings 8*b* and 8*c*. The inner sides of these sealing rings 7*a* and 7*b* which face the interior of the supporting sleeve 1 respectively abut the split rings 8 and 8*a* which are associated with the bearing units 6 and 5. These seals 7*a* and 7*b* prevent the possibility that lubricants which are provided for the lubrication of the bearing units 5 and 6 could become distributed into a greater space.

Distancing sleeves 20 and 21 are slipped over the separating sleeve 2 at the regions of the respective bearing units 5 and 6. The needle bearings 17 and 6 are mounted on these distancing sleeves 20 and 21. These distancing sleeves 20 and 21 are connected to the separating sleeve 2 by means of further split rings 8*d* and 8*e*, so that they are secured against axial shifting. The split rings 8*b* and 8*c* connect the shaft-type sealing rings 7*a* and 7*b* to the distancing sleeves 20 and 21. The sealing rings 7*a* and 7*b* have such a close fit on the separating sleeve 2 that neither water can penetrate from the exterior into the interior of the supporting sleeve 1, nor lubricant can escape from the interior of the supporting sleeve 1 into the surrounding water or into the interior of the watercraft.

The propeller shaft 3 which is driven in rotation by the output shaft 14 of the prime mover rotates the propeller 12 in a direction which depends on the desired direction of movement of the watercraft. As may be seen in the drawing, the propeller shaft 3 as well as the supporting sleeve 1 extend into the water which surrounds the stern region 10 of the watercraft. The surrounding water has a tendency to penetrate, on the one hand, into the interface between the separating sleeve 2 and the propeller shaft 3 and, on the other hand, into the space between the supporting sleeve 1 and the separating sleeve 2 and, ultimately, through one of these spaces, into the interior of the watercraft. The O-rings 4 prevent the penetration of the surrounding water through the interface between the separating sleeve 2 and the propeller shaft 3 even though the propeller shaft 3 is slidingly supported in the separating sleeve 2. This support has such tolerances that it permits the rotation of the propeller shaft 3 relative to the separating sleeve 2. However, inasmuch as the support of the separating sleeve 2 in the two bearing units 5 and 6 offers much less resistance than that of the propeller shaft 3 in the separating sleeve 2, rotation of the propeller shaft 3 relative to the separating sleeve 2 will be encountered only rarely.

The shaft-type seals 7*a* and 7*b* are advantageously formed with sealing lips which resiliently engage the respective juxtaposed surfaces of the support sleeve 1 and of the distancing sleeves 20 and 21, as a result of which the interior of the supporting sleeve 1 is reliably sealed with respect to the water which surrounds the supporting sleeve 1. In this manner, it is prevented that lubricants could escape from the interior of the supporting sleeve 1 and that they could pollute the surrounding water. By the same token, it is assured that no water from the exterior can penetrate into the interior of the supporting sleeve 1 and possibly damage the same or the elements accommodated therein.

The connection of the supporting sleeve 1 to the stern region 10 of the watercraft is achieved with the aid of a thread which is formed at that end of the supporting sleeve 1 which faces the propeller 12. This thread can be connected to a flange provided in the stern region 10.

On the other hand, it is also possible to embed the supporting sleeve 1 in the material of the stern region 10 of the watercraft, in a conventional manner. This type of connection is especially recommended for boats the hulls of which are made of wood or synthetic plastic material. However, it is also possible and contemplated by the present invention to use other kinds of connection of the supporting sleeve 1 to the stern region 10. So, for instance, depending on the respective requirements, any known connecting arrangement for rigidly connecting or affixing the supporting sleeve 1 to the stern region 10 can be chosen. However, it is also contemplated by the present invention to provide, in a conventional manner, for a flexible mounting of the supporting sleeve 1 on the stern region of the watercraft hull.

Other rolling-type or antifriction bearings can be used instead of the illustrated needle bearings for the mounting of the separating sleeve 2 in the supporting sleeve 1, such as ball bearings or rolling bearings. As far as the bearing unit 5 is concerned, such bearings or bearing combinations which are capable of sustaining not only radial but also axial forces are preferred.

The supporting sleeve 1 can be made of a material which does not corrode in water. Brass or bronze are materials having this property which come immediately to mind. However, even other materials, such as stainless steel or selected types of synthetic plastic materials can be used for the supporting sleeve 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. An arrangement for sealingly mounting a rotary member, particularly a propeller shaft, in a passage of a support, particularly of a watercraft hull, comprising dynamic sealing means; bearing means; and separating means interposed between and fluid-tightly separating said sealing means and said bearing means; wherein said separating means includes a separating sleeve surrounding the rotary member for relative movement; wherein said sealing means is interposed between said separating sleeve and the rotary member; and further comprising a support sleeve mounted in the passage; and wherein said separating sleeve is received in said support sleeve for rotation relative thereto.

2. The arrangement as defined in claim 1, wherein said bearing means is accommodated between said support sleeve and said separating sleeve.

3. The arrangement as defined in claim 2, wherein said bearing means includes at least two bearing units.

4. The arrangement as defined in claim 3, wherein at least one of said bearing units includes at least one rolling bearing.

5. The arrangement as defined in claim 4, wherein at least said one bearing unit includes a radial bearing and an axial bearing.

6. The arrangement as defined in claim 5, wherein the other bearing unit includes only a radial bearing.

7. The arrangement as defined in claim 6, wherein at least one of said radial bearings is a needle bearing.

8. The arrangement as defined in claim 5, wherein said axial bearing is a ball bearing.

9. The arrangement as defined in claim 3, wherein at least one of said bearing units includes at least one sliding bearing.

10. The arrangement as defined in claim 8, wherein the other bearing unit also includes at least one sliding bearing.

11. The arrangement as defined in claim 2, wherein said sleeves together delimit an intermediate space accommodating said bearing means; and further comprising additional sealing means arranged in said intermediate space at the respective ends thereof and operative for sealing said space with respect to the environment.

12. The arrangement as defined in claim 1; and further comprising means for connecting said support sleeve to the support.

13. The arrangement as defined in claim 1, wherein said support sleeve is embedded in the support.

14. The arrangement as defined in claim 1, wherein said support sleeve is mounted in the support in a flexible manner.

15. An arrangement for sealingly mounting a propeller shaft in a passage of a watercraft hull, comprising a supporting sleeve, a seam-free separating sleeve, said separating sleeve is received in said supporting sleeve for rotation relative thereto and the propeller shaft is received in said separating sleeve for coaxial rotation relative thereto, dynamic sealing means positioned between said separating sleeve and the propeller shaft for forming a fluid-tight seal therebetween to prevent intrusion of water therebetween and corrosion of the propeller, distancing sleeve means positioned between said supporting sleeve and said separating sleeve, bearing means positioned between said supporting sleeve and said distancing sleeve means, second sealing means positioned between said supporting sleeve and said distancing sleeve means for forming a fluid-tight seal surrounding the bearing means to prevent escape of lubricant from the bearing means into the water and access of water to the bearing means, said separating sleeve forming a fluid-tight and protective wall between said bearing means and second sealing means on the one hand and the propeller shaft and said dynamic sealing means on the other hand.

16. The arrangement as defined in claim 15, wherein the propeller shaft is slidably received in said separating sleeve.

17. The arrangement as defined in claim 15 further comprising second bearing means positioned between said supporting sleeve and said separating sleeve.

18. The arrangement as defined in claim 15 wherein said dynamic sealing means includes at least one O-ring and at least one groove in the interior face of said separating sleeve in which said O-ring is received.

19. The arrangement as defined in claim 18, wherein each said groove accomodates only one O-ring.

20. The arrangement as defined in claim 15, wherein said dynamic sealing means comprises a plurality of O-rings positioned between said separating sleeve and the propeller shaft.

21. The arrangement as defined in claim 15, wherein said bearing means includes two bearing units spaced apart at first and second positions along the axis of said supporting sleeve and two split rings for respectively securing said bearing units to said supporting sleeve at said positions to prevent radial, longitudinal or axial shifting of said bearing units.

22. An arrangement as defined in claim 21, wherein the bearing units rotatably support said separating sleeve.

23. The arrangement as defined in claim 21, wherein said second sealing means comprises two sealing rings spaced apart at positions along the axis of said supporting sleeve outwardly of said first and second positions and two further split rings for respectively securing said sealing rings to said distancing sleeve means.

24. The arrangement as defined in claim 23, wherein one of said sealing rings abuts one of said split rings associated with said bearing units and the other of said sealing rings abuts the other of said split rings associated with said bearing units.

25. The arrangement as defined in claim 21, wherein at least one of said bearing units includes a needle bearing mounted on said distancing sleeve means.

26. An arrangement as defined in claim 15, further comprising split ring means for connecting said distancing sleeve means to said separating sleeve to prevent relative axial shifting therebetween.

* * * * *